US006074236A

United States Patent [19]

Wu

[11] Patent Number: 6,074,236

[45] Date of Patent: Jun. 13, 2000

[54] GUIDE POST STRUCTURE OF ELECTRICAL CONNECTOR

[75] Inventor: Kun-Tsan Wu, Tu-Chen, Taiwan

[73] Assignee: Hon Hai Precision Ind. Co., Ltd., Taipei Hsien, Taiwan

[21] Appl. No.: 09/291,806

[22] Filed: Apr. 14, 1999

[30] Foreign Application Priority Data

Oct. 17, 1998 [TW] Taiwan ..... 87217147

[51] Int. Cl.[7] ..... H01R 13/648

[52] U.S. Cl. ..... 439/378; 439/825

[58] Field of Search ..... 439/378–381, 439/827, 825, 826, 668, 828

[56] References Cited

U.S. PATENT DOCUMENTS

| | | | |
|---|---|---|---|
| 5,158,484 | 10/1992 | Chou | 439/668 |
| 5,356,300 | 10/1994 | Costello et al. | 439/101 |
| 6,007,364 | 12/1999 | Wu | 439/378 |

*Primary Examiner*—Renee Luebke
*Assistant Examiner*—J. F. Duverne
*Attorney, Agent, or Firm*—Wei Te Chung

[57] ABSTRACT

A guide post of an electrical connector includes an elongate conductive body having a threaded section which engages with an innerthreaded hole defined in a connector and a front section extending from the threaded section. The front section defines a diametrical slot coextensive therewith for receiving a conductive spring member. The spring member has two spaced arms. The arms have a first end fixed together and a second free end. Each arm also has a convex section formed between the ends and extending beyond the slot. The arm is resilient thereby allowing the convex section to retract into the slot upon receiving an external force. When inserting the guide post into a receptacle hole defined in a mating connector, the convex sections are forced into the slot by means of contact engagement with an inner surface of the receptacle hole thereby facilitating a smooth insertion of the guide post into the receptacle hole. The resiliency of the arms maintains the convex sections in contact engagement with the inner surface of the receptacle hole thereby providing a secure electrical and mechanical engagement therebetween.

8 Claims, 4 Drawing Sheets

GUIDE POST STRUCTURE OF ELECTRICAL CONNECTOR

BACKGROUND OF THE INVENTION

1. Field of the Invention

The present invention generally relates to a guide post mounted on an electrical connector for guiding engagement between the connector and a mating connector, and in particular to a guide post having a spring member for ensuring stable electrical and mechanical engagement between the two connectors.

2. The Prior Art

Electrical connectors are used to connect two electrical devices. To provide a secure engagement between two mating connectors, one of the connectors is usually provided with guide posts which are receivable in receptacle holes defined in the mating connector. Examples are shown in U.S. Pat. Nos. 5,466,171 and 5,478,253 and Taiwan Patent Application No. 81212364.

The guide post provides two functions. The guide post guides the engagement between two mating connectors. The guide post also provides a grounding measure which discharges electrostatic charges before actual engagement occurs, thus protecting the associated circuit from being damaged by the electrostatic charges.

Due to manufacturing tolerance, the dimension of the guide post may not exactly correspond to the receptacle hole. Therefore, either an overly tight engagement or a loose engagement may exist therebetween. An overly tight engagement hinders connection/disconnection between the two mating connectors and may damage the connectors, while a loose engagement does not provide a stable connection between the two connectors.

It is thus desirable to have a guide post of an electrical connector which eliminates the possibility of an overly tight engagement or loose engagement from occurring between the guide post and a receptacle hole of two mating connectors.

SUMMARY OF THE INVENTION

Accordingly, an object of the present invention is to provide a guide post of an electrical connector which facilitates smooth insertion thereof into a receptacle hole defined in a corresponding mating connector.

Another object of the present invention is to provide a guide post of an electrical connector which provides a stable electrical and mechanical engagement between the connector and a mating connector.

A further object of the present invention is to provide a guide post of an electrical connector which is less likely to cause damage to the connector during insertion into receptacle hole defined in a mating connector.

To achieve the above objects, a guide post in accordance with the present invention comprises an elongate conductive body having a threaded section which engages with an inner-threaded hole defined in a connector and a front section extending from the threaded section. The front section defines a diametrical slot co-extensive therewith for receiving a conductive spring member. The spring member comprises two spaced arms. The arms have a first end fixed together and a second free end. Each arm also has a convex section formed between the ends and extending beyond the slot. The arm is resilient thereby allowing the convex section to retract into the slot upon receiving an external force. When inserting the guide post into a receptacle hole defined in a mating connector, the convex sections are forced into the slot by means of contact engagement with an inner surface of the receptacle hole thereby facilitating smooth insertion of the guide post into the receptacle hole. The resiliency of the arms maintains the convex sections in contact engagement with the inner surface of the receptacle hole thereby providing a secure electrical and mechanical engagement therebetween.

BRIEF DESCRIPTION OF THE DRAWINGS

The present invention will be apparent to those skilled in the art by reading the following description of a preferred embodiment thereof, with reference to the accompanying drawings, in which.

DETAILED DESCRIPTION OF THE PREFERRED EMBODIMENT

Figure 1:
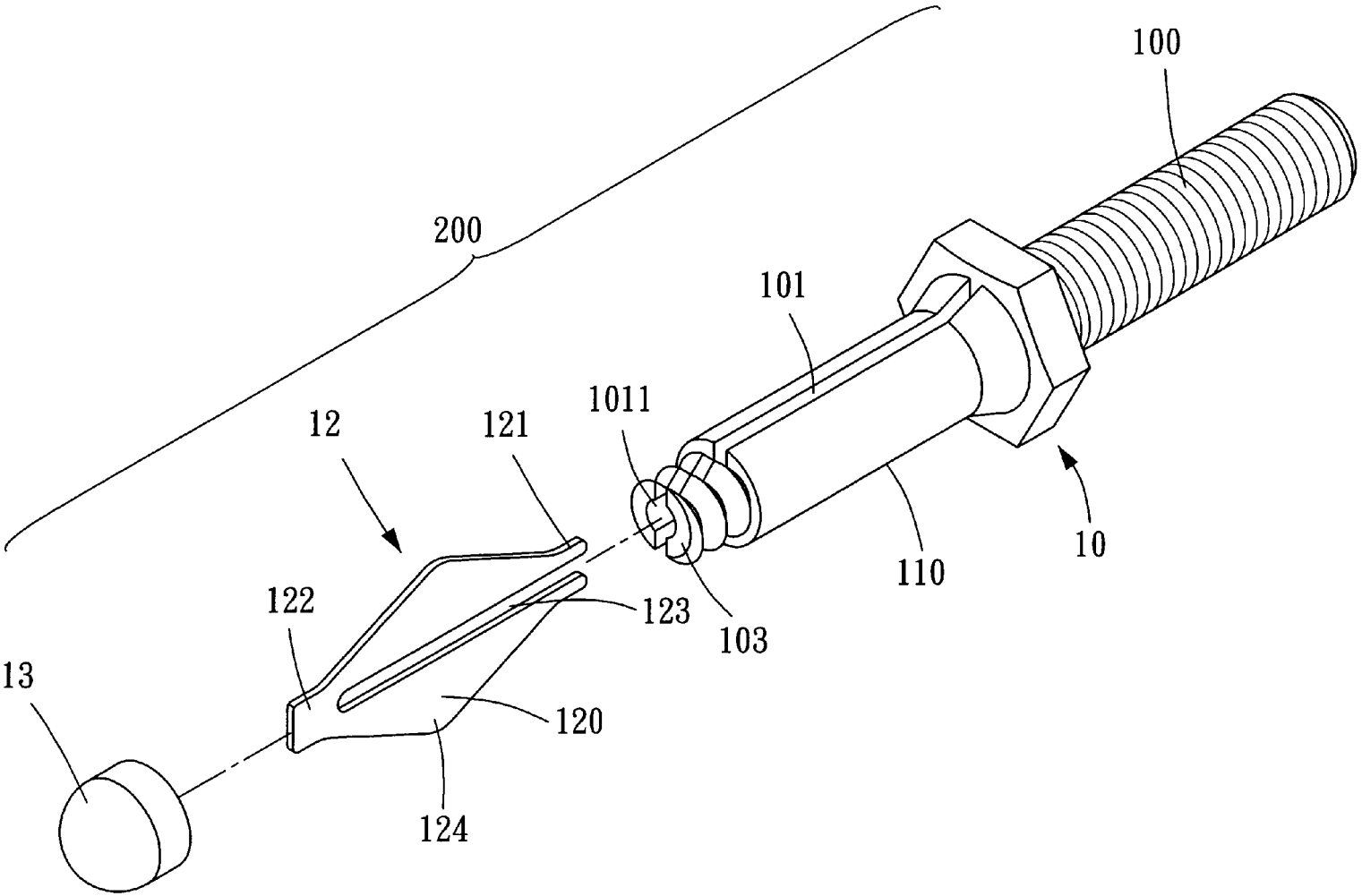
FIG. 1 is an exploded view of a guide post constructed in accordance with the present invention.
Figure 3:
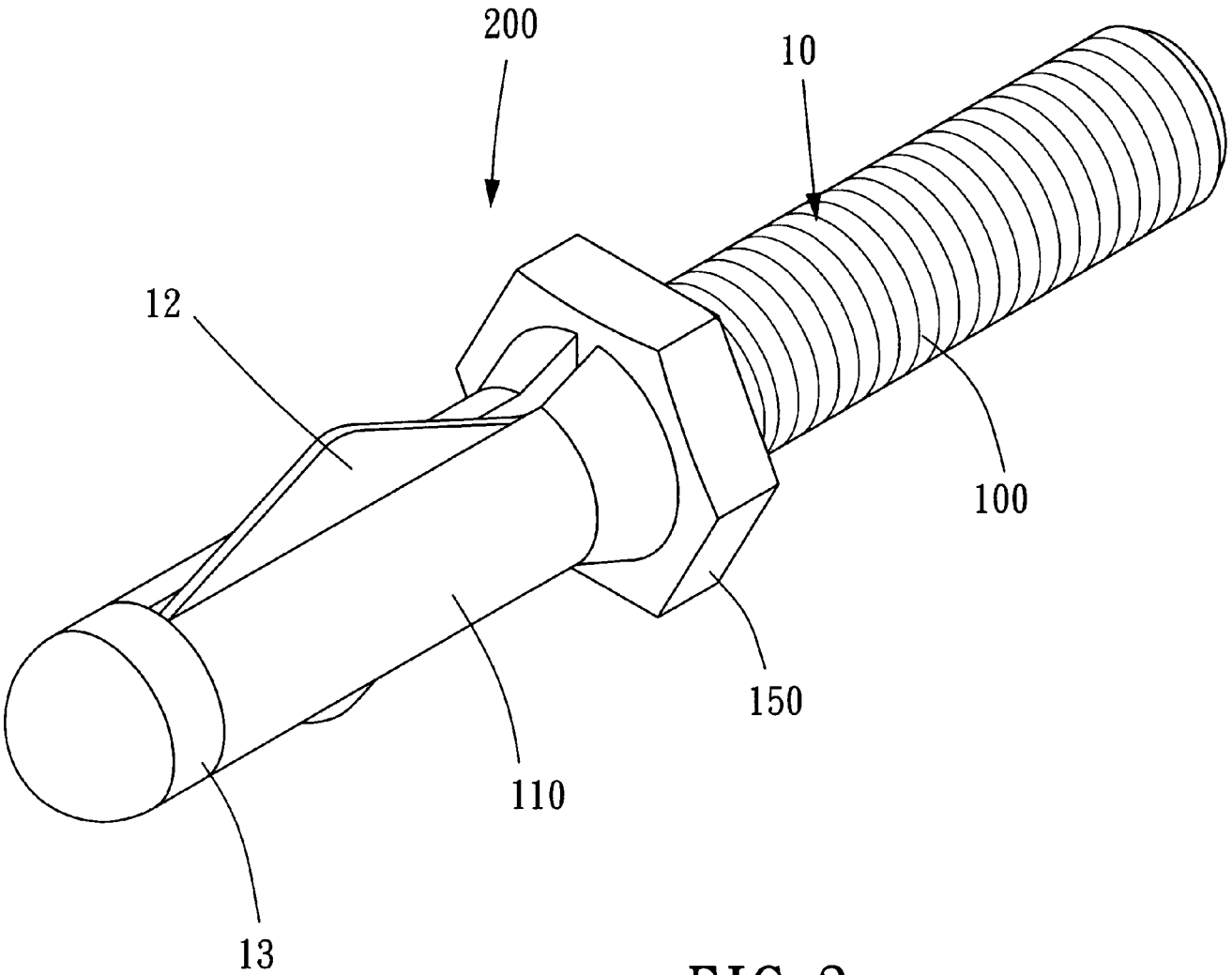
FIG. 3 is an assembled view of FIG. 1.

Referring to the drawings and in particular to FIGS. 1 and 3, a guide post 200 adapted to be mounted to an electrical connector in accordance with a preferred embodiment of the present invention comprises an elongate body 10 having a tail section 100 which is externally threaded and a front section 110 substantially co-axial with and extending from the tail section 100. Preferably, a hexagonal section 150 is formed between the tail section 100 and the front section 110.

The front section 110 defines a slot 101 co-extensive therewith. The slot 101 is defined through the front section 110, preferably in a diametrical direction. An engaging spring member 12, made of conductive material, is received in the slot 101. The front section 110 has a free end 103 on which an external threading is formed. An inner-threaded rounded cap 13 engages with the threaded free end 103.

The engaging member 12 comprises two arms 120 which are spaced from each other a distance 123. The arms 120 have a first end connected together by means of a connection section 122 and a second, free end 121 which, due to the resiliency of the arms 120, are movable with respect to each other in order to alter the distance 123 between the arms 120. Each arm 120 has a convex section 124 which extends beyond the slot 101 and is retractable into the slot 101 when acted upon by an external force.

The connection section 122 of the engaging member 12 is received in the inner-threaded cap 13 thereby being secured in position by the cap 13. A recess 102 (FIG. 2) is defined in the front section 110 in communication with an inner end of the slot 101 for receiving and retaining the free ends 121 of the arms 120 therein, while allowing the free ends 121 of the arms 120 to move with respect to each other.

Figure 2:
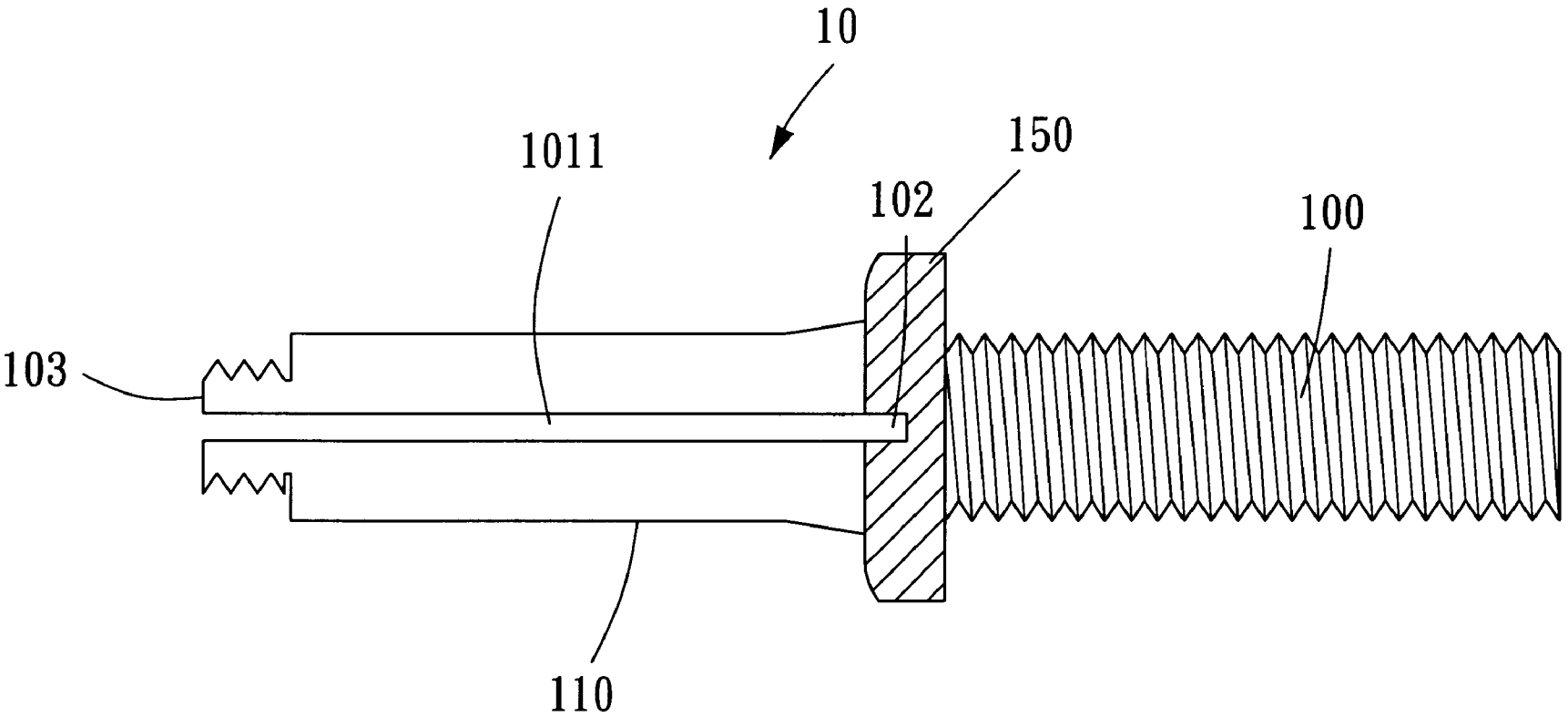
FIG. 2 is a cross-sectional view of an elongate body of the guide post of the present invention.

The recess 102 may be formed by drilling a central bore 1011 from the free end 103 of the front section 110 into the hexagonal section 150 as shown in FIG. 2. The bore 1011 coincides with the slot 101 in the embodiment illustrated.

Figure 4:
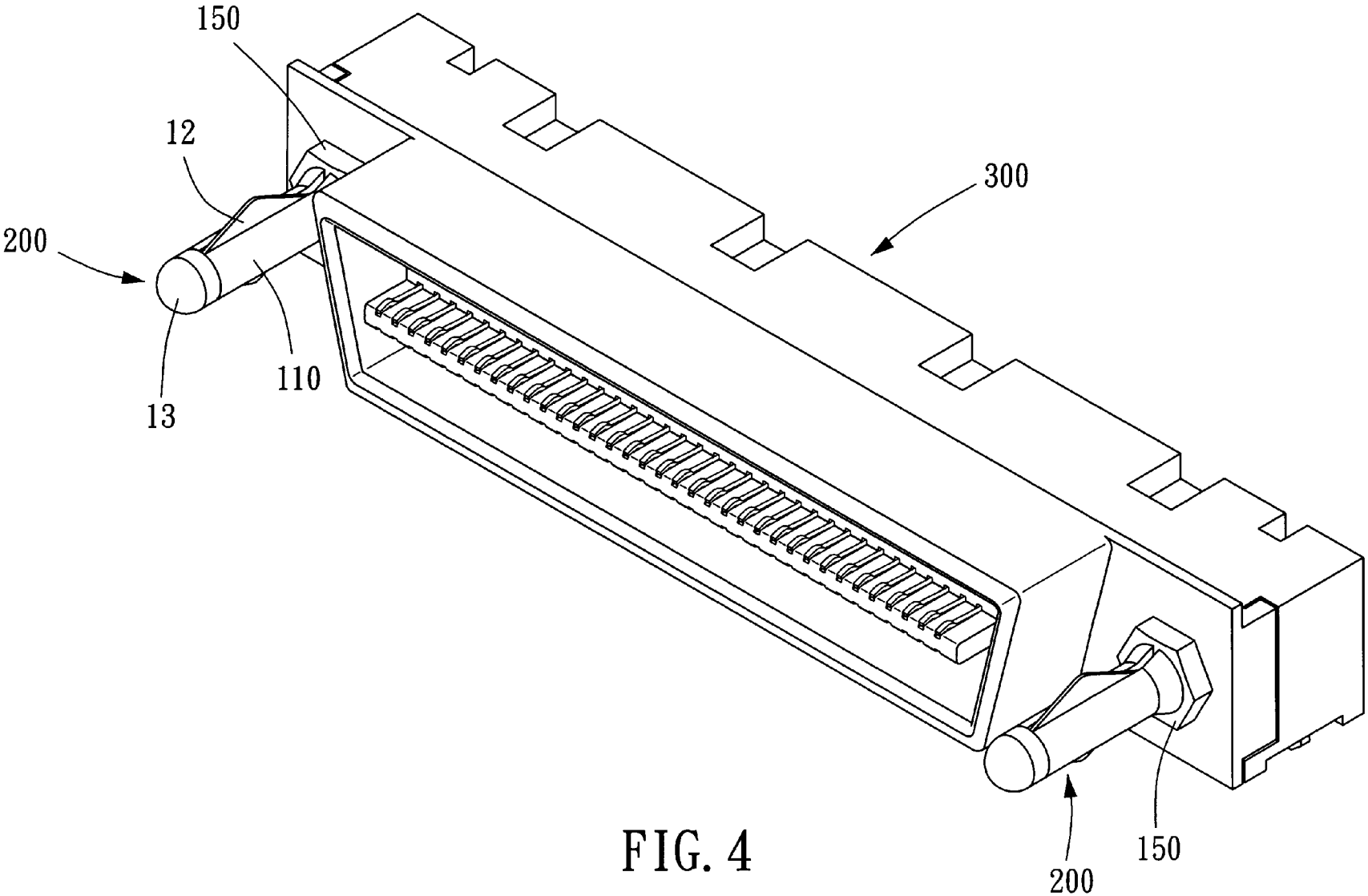
FIG. 4 is a perspective view of an electrical connector on which two guide posts in accordance with the present invention are mounted.

FIG. 4 shows an electrical connector 300 on which two of the guide posts 200 in accordance with the present invention are mounted. The connector 300 is provided with an inner-threaded hole (not shown) for engaging with each of the guide posts 200. The hexagonal section 150 allows the use of a wrench to tighten the guide post 200 onto the connector 300. The front section 110 extends from the connector 300.

When mating the connector 300 with a corresponding mating connector (not shown), the guide posts 200 are first inserted into corresponding receptacle holes defined in the mating connector. During insertion into the receptacle holes, the convex sections 124 of the arms 120 extending beyond the slot 101 contact inner surfaces of the receptacle holes thereby forcing the arms 120 into the slot 101 to facilitate smooth insertion of the guide posts 200 into the receptacle holes. The resiliency of the arms 120 helps maintain a stable electrical and mechanical engagement between the guide posts 110 and the receptacle holes.

Although the present invention has been described with reference to a preferred embodiment, it is apparent to those skilled in the art that a variety of modifications and changes may be made without departing from the scope of the present invention which is intended to be defined by the appended claims.

What is claimed is:

1. A guide post adapted to be mounted to an electrical connector for insertion into a receptacle hole defined in a mating connector to establish electrical and mechanical engagement therebetween, the guide post comprising:

an elongate conductive body having a tail section and a front section, the tail section having an external threading engageable with an inner-threaded hole defined in the electrical connector, the front section defining a slot coextensive therewith; and a conductive spring member comprising two resilient arms spaced from each other, the arms having a first end fixed together and a free end which is movable with respect to each other and are retractable into the slot, each of the resilient arms having a convex section between the first end and the free end and extending beyond the slot and adapted to contact an inner surface of the receptacle hole to establish the electrical and mechanical engagement therebetween.

2. The guide post as claimed in claim 1, wherein the resiliency of the arms allows the arms to be retractable into the slot thereby facilitating smooth insertion of the guide post into the receptacle hole.

3. The guide post as claimed in claim 1, wherein the front section has a free end over which a cap defining a cavity is fit.

4. The guide post as claimed in claim 3, wherein the free end of the front section is externally threaded and wherein the cavity of the cap is inner-threaded to engage with the threaded free end of the front section.

5. The guide post as claimed in claim 3, wherein the first ends of the resilient arms of the spring member are received and retained in the cavity of the cap.

6. The guide post as claimed in claim 5, wherein the front section defines a recess therein for receiving and retaining the free ends of the arms of the spring member.

7. The guide post as claimed in claim 1, wherein the elongate body further comprises an intermediate section between the tail section and the front section, the intermediate section having a polygonal configuration.

8. The guide post as claimed in claim 7, wherein the intermediate section comprises a hexagonal configuration.

* * * * *